US005901998A

United States Patent [19]

Gallo, Jr.

[11] Patent Number: 5,901,998

[45] Date of Patent: May 11, 1999

[54] MULTI-FUNCTIONAL TOOL AND PARTS CARRIER

[76] Inventor: Joseph A. Gallo, Jr., 709 Ridgeside Dr. F, Ballwin, Mo. 63021

[21] Appl. No.: 08/636,636

[22] Filed: Apr. 23, 1996

[51] Int. Cl.[6] ..... E06C 7/14

[52] U.S. Cl. ..... 294/143; 182/129; 248/210; 294/146

[58] Field of Search ..... 294/141–146, 294/159; 182/129; 106/372, 373; 211/70.6; 220/570; 248/210, 229.17, 238, 318; 312/244

[56] References Cited

U.S. PATENT DOCUMENTS

| | | | |
|---|---|---|---|
| 4,526,414 | 7/1985 | Jones | 294/143 |
| 4,653,713 | 3/1987 | Hamilton | 182/129 X |
| 4,706,918 | 11/1987 | Wilson | 248/210 |
| 5,333,823 | 8/1994 | Joseph | 248/210 X |
| 5,370,263 | 12/1994 | Brown | 248/210 X |
| 5,505,302 | 4/1996 | Ferley | 182/129 X |
| 5,542,553 | 8/1996 | Penniman | 211/70.6 |
| 5,603,405 | 2/1997 | Smith | 182/129 X |
| 5,649,623 | 7/1997 | Kornblatt | 248/210 X |

*Primary Examiner*—Johnny D. Cherry
*Attorney, Agent, or Firm*—Grace J. Fishel

[57] ABSTRACT

A multi-functional ladder-top tool and parts carrier which has rubber legs for non-damaging support on flat surfaces and a bottom recess conforming to the upper surface of a ladder, a wide handle for easy one-handed or two-handed movement of the carrier to the upper surface of the ladder, and at least one strap attached to the carrier to secure it to the upper surface of the ladder. The carrier also has a variety of different sized openings through its top surface through which different types of tools and parts may be placed which allow for organized storage and ease of access by a person working on or adjacent to the upper surface of the ladder. Applications may include, but are not limited to, use on ladders and stools, use independent from ladders and stools, and use in the storage and organization of household items such as cleaning tools and supplies, holiday decorations and the tools and supplies needed to secure them in place, and the tools and parts needed for hanging pictures, drapes, and window blinds.

20 Claims, 4 Drawing Sheets

MULTI-FUNCTIONAL TOOL AND PARTS CARRIER

BACKGROUND

1. Field of the Invention

This invention relates to ladder top tool trays and carriers, specifically to a multi-functional ladder top tool and parts carrier which has rubber legs for non-damaging support on flat surfaces and a bottom recess conforming to the upper surface of a conventional ladder, with a wide handle which easily conforms to both one-handed and two-handed use for use by people of differing strengths, at least one elongated strap attached to the carrier which secures the carrier to the upper surface of the ladder, and an assortment of different sized openings through its top surface which allow for organized storage and ease of access to different types of tools and parts stored in the carrier. Applications may include, but are not limited to, use on ladders and stools, use independent from ladders and stools, and use in the storage and organization of household items such as cleaning tools and supplies, holiday decorations and the tools and supplies needed to secure them in place, and the tools and parts needed for hanging pictures, drapes, and window blinds.

BACKGROUND

2. Description of the Prior Art

Working on a ladder takes stamina. One must repeatedly climb up and down the ladder, one must move the ladder from one location to another, and one usually must also carry tools and parts up and down the ladder. To save unnecessary movement up and down a ladder, it is useful for a person to have tool trays or tool holders which will support one or more of the tools a person might need while working near the upper portion of the ladder.

Many types of ladder accessories are known for supporting tools and parts. The invention in U.S. Pat. No. 4,653,713 to Hamilton (1987) discloses a T-shaped mounting for attachment to the top platform of a step ladder and which will engage with a T-shaped tunnel in the base of a tool container to securely fasten it to the step ladder's top platform. In contrast, the invention in U.S. Pat. No. 5,181,682 to Indelicato (1993) discloses a cylindrical section of piping adapted to hold an elongated hand tool which is connected to a U-shaped mounting member with outwardly biasing legs for insertion within hollow rungs of a ladder. Further, the invention in U.S. Pat. No. 5,342,008 to Kay (1994) discloses a tray supported upon brackets attached to both sides of a step ladder, while the invention in U.S. Pat. No. 5,402,910 to Pilney (1995) discloses a rectangular receptacle with a generally U-shaped handle pivotally connected to the receptacle so that when a horizontal hanging bar connected to the handle is attached to the step or rung of a ladder, the receptacle remains in an upright position for the storage of tools and parts. A disadvantage of the Hamilton, Kay, and Pilney inventions is that their storage of individual parts and tools is not as convenient, well organized, and readily accessible as the storage provided by the present invention. Also, a disadvantage of the cylindrical section of piping of the Indelicato invention is that it does not provide for the storage of as wide a variety of tools and parts as that which is provided by the present invention.

The prior art most closely related to the present invention are the inventions disclosed in U.S. Pat. No. 5,419,409 to Corulla (1995) and U.S. Pat. No. 5,437,502 to Warnik (1995). The Corulla invention discloses a flip top tool holder which is attached to the top portion of a ladder for use in holding both electrically powered tools and non-electric hand tools. Hand tools are inserted through openings in the flip top portion of the tool holder where a portion of the hand tool remains above the surface of the flip top portion within easy reach of the person working on the ladder. It is contemplated for the Corulla invention to be used with a ladder having a component in the head step for supplying electrical current. One disadvantage of the Corulla invention is that it is not as convenient to use as the present invention. The Warnik invention discloses a holder for tools and the like having a frame with a plurality of compartments and removable drawers for placement within the compartments. The Warnik invention also discloses a removable jacket which substantially covers the frame which is configured to form a cavity for placement upon the apex of a ladder. Individual tools may be displayed and accessed when placed in tool holders attachable to the Warnik invention. One disadvantage of the Warnik invention is that it has drawers which must be opened and closed so that the parts and tools stored therein are not as readily available as those stored in the present invention. It is not known to have a multi-functional ladder top tool and parts carrier which has rubber legs for non-damaging support on flat surfaces and a bottom recess conforming to the upper surface of a conventional ladder, with a wide handle which easily conforms to both one-handed and two-handed use by people of differing strengths, a strap attached to the carrier which secures the carrier to the upper surface of the ladder, and an assortment of different sized openings through its top surface which allow for organized storage and easy access to different types of tools and parts stored in the carrier.

SUMMARY OF INVENTION—OBJECTS AND ADVANTAGES

It is the primary object of this invention to provide a multi-functional ladder top tool and parts carrier for use on or off of a ladder which will organize a variety of tools and parts and have them within easy reach of a user. It is also an object of this invention to provide a ladder top tool and parts carrier which will organize tools and parts and have them within easy reach of a person on a ladder. It is also an object of this invention to provide a ladder top tool and parts carrier which will save movement of the user up and down a ladder during completion of a work project. A further object of this invention is to provide a ladder top tool and parts carrier which will store an assortment of tools and parts needed to complete a variety of commonly performed household maintenance and decorative projects. It is also an object of this invention to provide a ladder top tool and parts carrier which has an easy to use means for secure attachment of the carrier to the top step of a ladder. It is also an object of this invention to provide a ladder top tool and parts carrier which has a wide handle for convenient one-handed and two-handed use in moving the carrier up and down the ladder.

As described herein, properly manufactured and secured to the top step of a ladder or stool, the present invention would provide a means for organizing a variety of tools and parts within the easy reach of a person working on or adjacent to the ladder or stool. A wide handle connected to the upper surface of the carrier allows for convenient one-handed and two-handed use by most members of a household who would have varying muscular strength. A recess in the bottom of the present invention, which conforms to the shape of the top step of the ladder or stool, and a strap centrally attached to the support structure of the present invention, hold the present invention securely to the upper surface of the ladder or stool. Rubber legs that will not mar or scratch flat surfaces are attached to the bottom of the carrier to support it in a stable, upright condition when used independently from the ladder or stool. Since the present invention has openings of varying sizes and shapes, the present invention will hold a variety of tools and parts to save movement of the user up and down a ladder or stool during completion of a work project. The diverse nature and number of the configurations of the support structure opening configurations also allows a user to store together an assortment of tools and parts needed to complete a variety of commonly performed household maintenance and decorative projects, such as routine cleaning tasks, the hanging of holiday decorations, and the hanging of pictures, drapes, and window blinds.

The description herein provides preferred embodiments of the present invention but should not be construed as limiting the scope of the ladder top tool and parts carrier invention. Variations in the height of the carrier, the width of the carrier, the number of cavities opening through the upper surface of the carrier, the configurations of cavities opening through the upper surface of the carrier, the shape and size of the handle attached to the carrier, the material from which the securing strap is made, and the means by which the securing strap fixes the carrier to the top step of the ladder, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
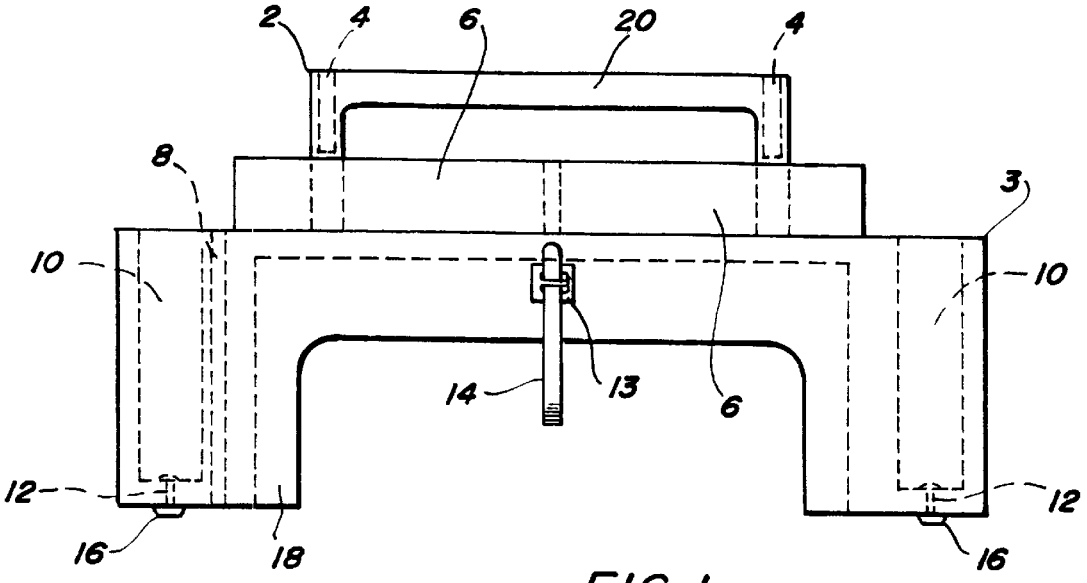
FIG. 1 is a front view of the invention.
Figure 2:
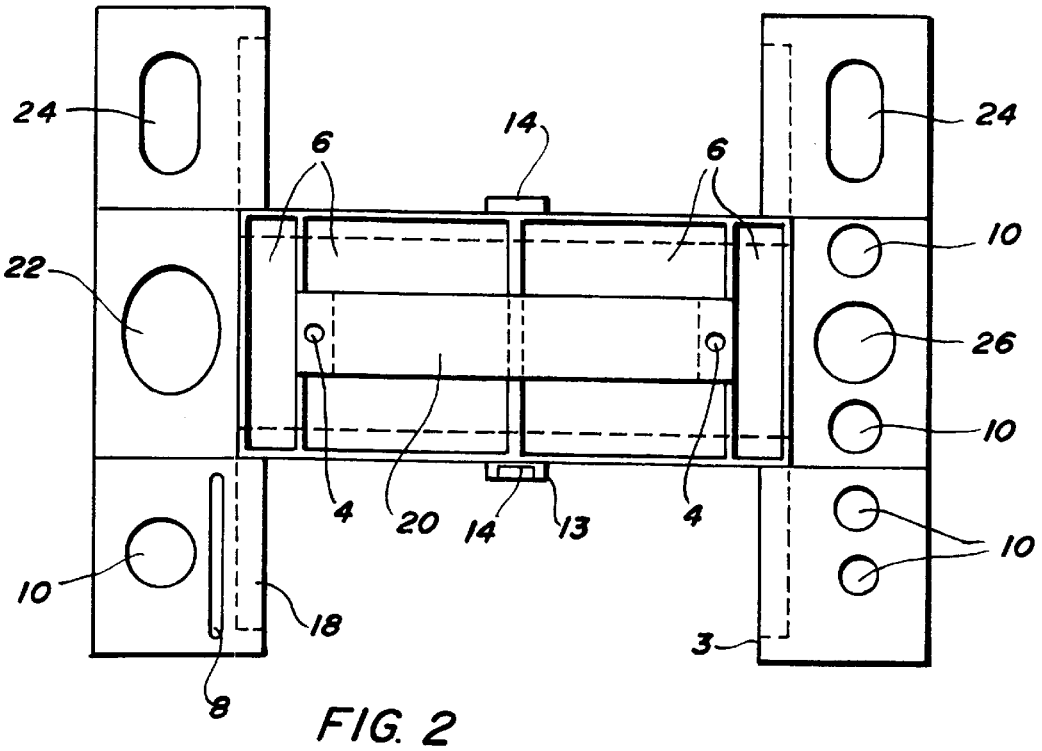
FIG. 2 is a top view of the invention.
Figure 3:
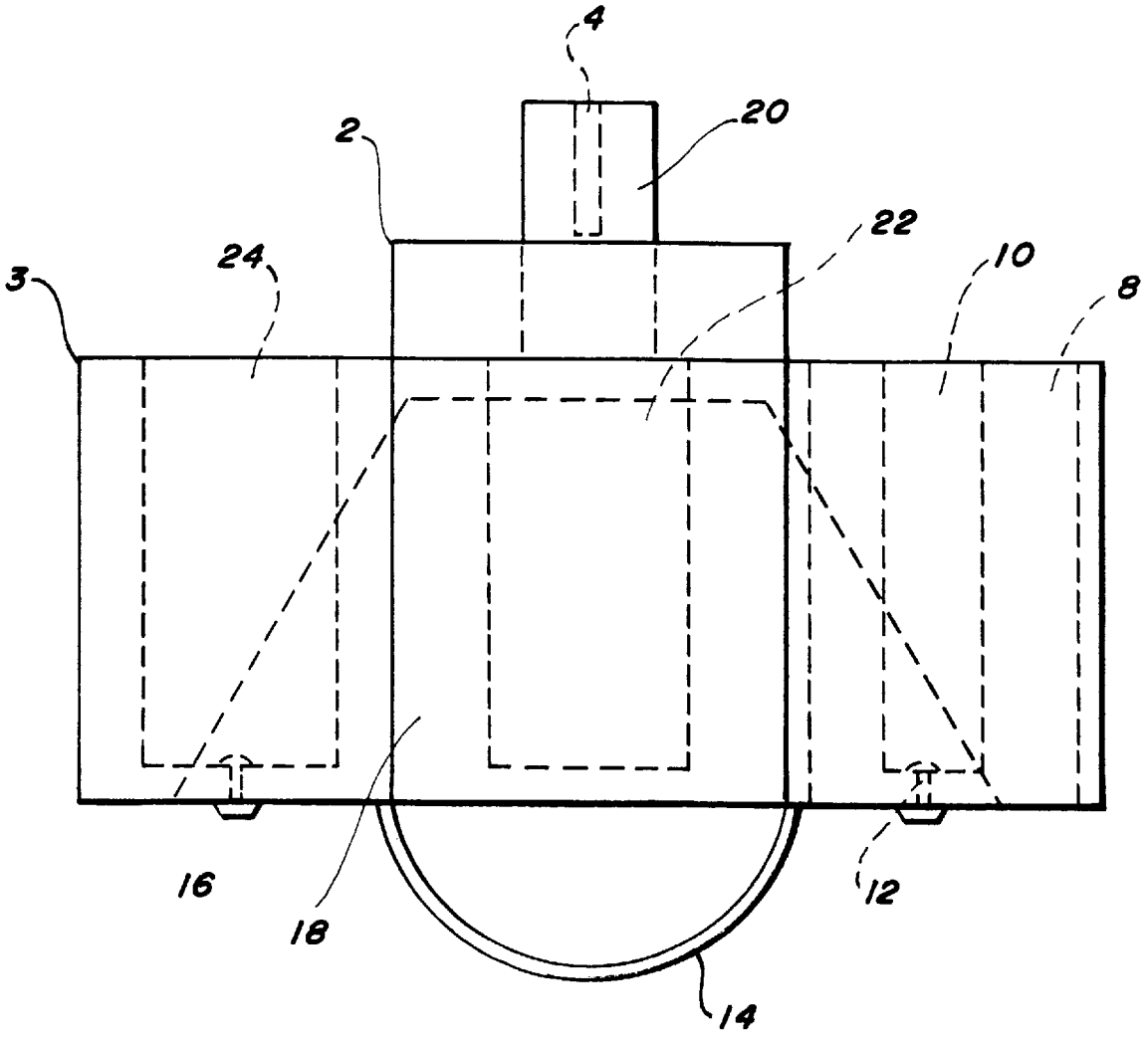
FIG. 3 is a side view of the invention.
Figure 4:
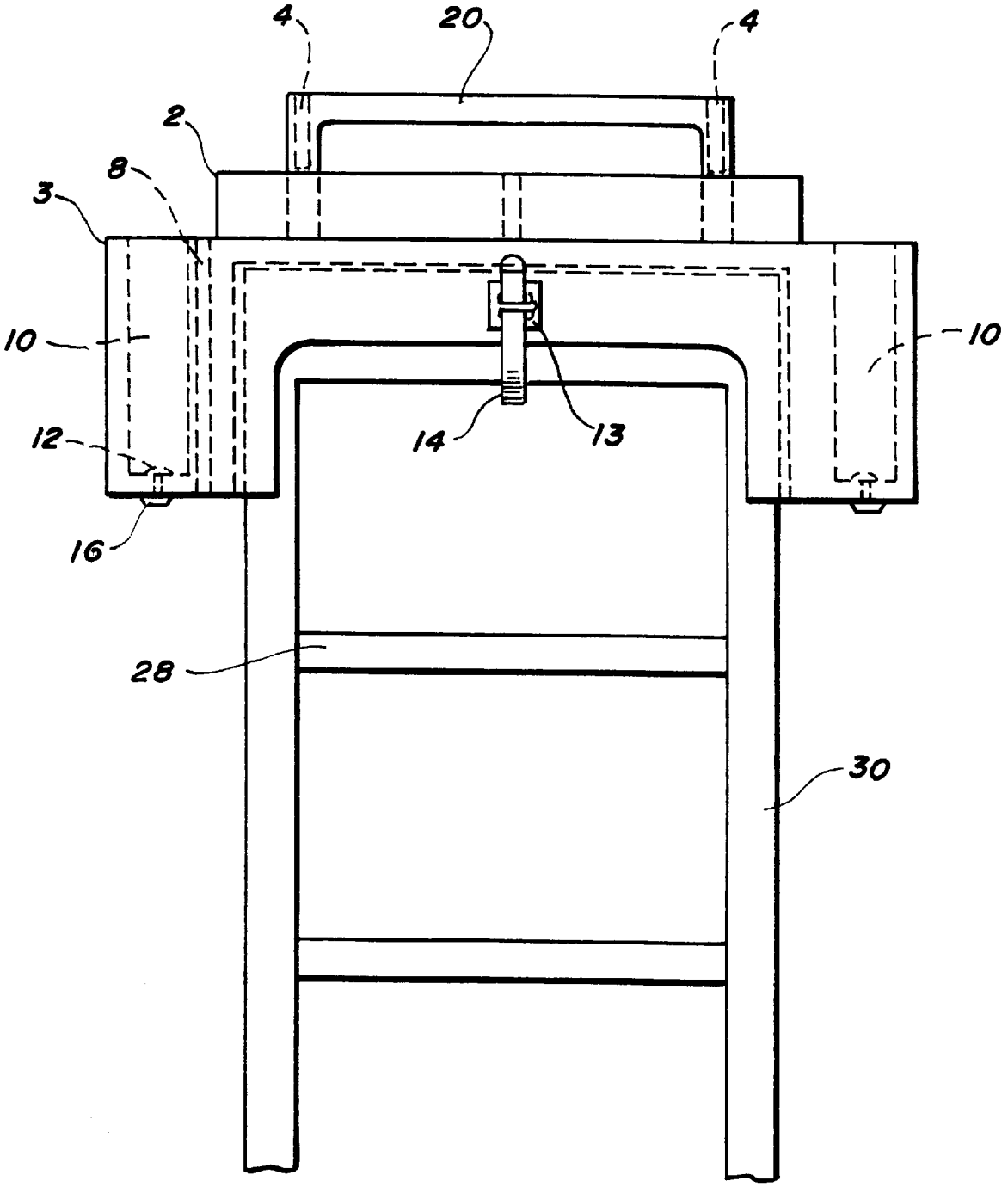
FIG. 4 is a front view of the invention secured to a ladder.
Figure 5:
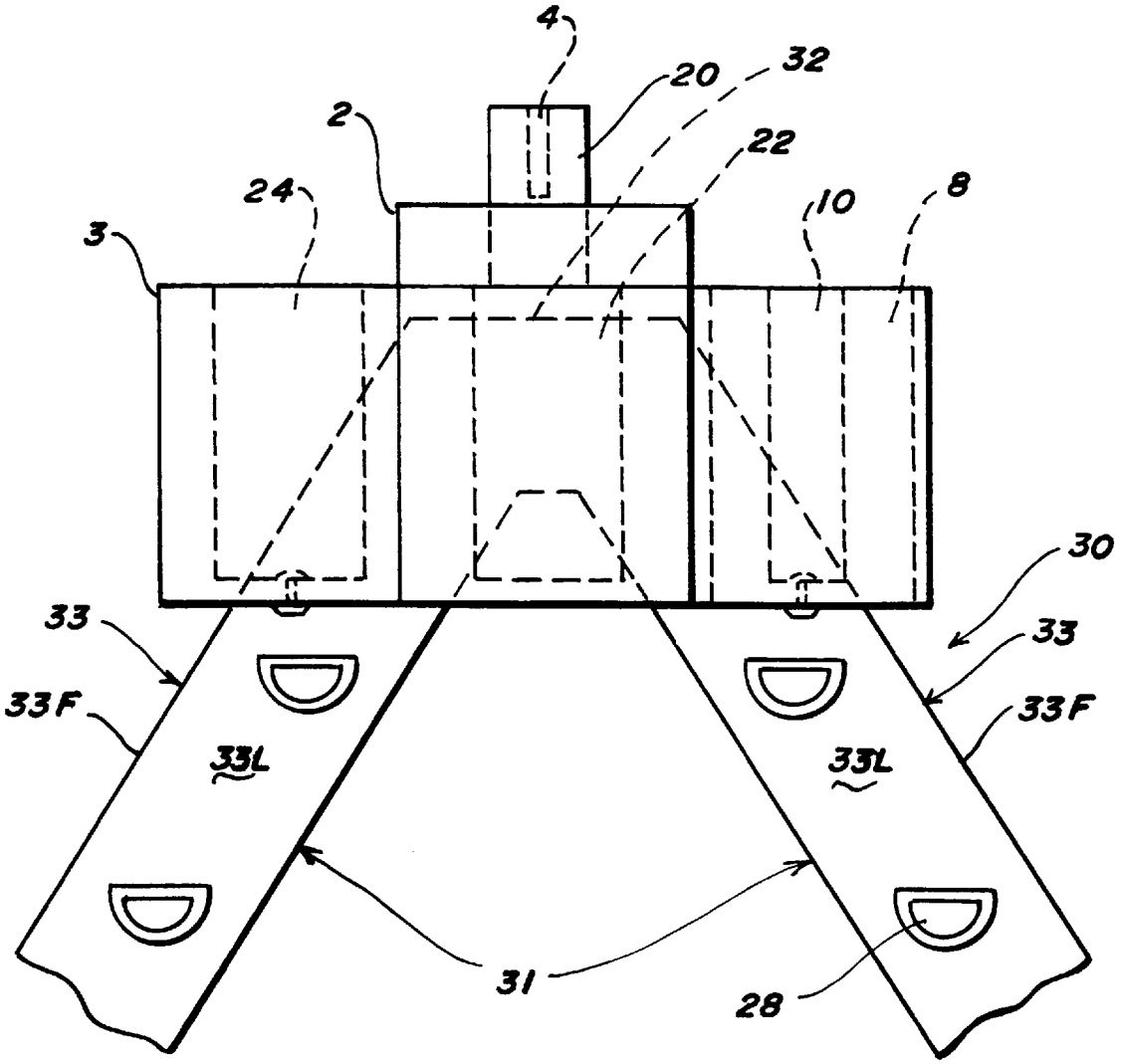
FIG. 5 is a side view of the invention secured to a ladder.

FIGS. 1, 2, and 3 show a preferred embodiment of a ladder top tool and parts carrier invention 2 having a support structure 3, a handle 20 connected to the top portion of support structure 3, and a recess 18 formed in the bottom surface of support structure 3 into which the top step of a ladder, shown in FIGS. 4 and 5 as number 30, may be positioned for support of support structure 3 during use on ladder 30. Ladder 30, as shown in the drawings, is a step ladder having two angled frames 31 joined at a top with a flat step 32. Each of the angled frames has a pair at uprights 33 and each of the uprights has an outboard lateral face 33L and an outboard front face 33F. The overall size and configuration of support structure 3 and handle 20 are not critical to ladder top tool and parts carrier invention 2. However, handle 20 must be wide enough to allow convenient one-handed and two-handed use by people of varying muscular strengths. Also, the exact size and configuration of recess 18 is not critical to ladder top tool and parts carrier invention 2 as long as recess 18 is able to accommodate the upper portion of ladder 30. FIGS. 1, 2, and 3 also show a strap 14 connected to the central portion of support structure 3, pencil holder cavities 4 opening through the upper surface of lateral portions of handle 20, screwdriver cavities 10 opening through the upper surface of lateral portions of support structure 3 to hold screwdrivers (not shown) and similarly configured tools (not shown), and a squaring tool slot 8 also positioned through the upper surface of support structure 3. The material from which strap 14 is made is not critical to ladder top tool and parts carrier invention 2. Also, although not shown, it is contemplated for the configurations of pencil holder cavities 4, screwdriver cavities 10, and squaring tool slot 8 to be wide enough to house at least one pencil, one screwdriver, and one squaring tool, respectively, and deep enough so that a portion of each pencil, each screwdriver, and each squaring tool extends beyond the upper openings of its respective pencil holder cavity 4, screwdriver cavity 10, and squaring tool slot 8 for easy access by a user. In addition FIGS. 1 and 2 show strap 14 having a buckle 13 and parts cavities 6 positioned adjacent to handle 20. FIGS. 1 and 3 also show ladder top tool and parts carrier invention 2 having legs 16 connected to the bottom of support structure 3 with bolts 12 for use in supporting ladder top tool and parts carrier invention 2 on flat surfaces (not shown) other than the top of ladder 30 or a stool (not shown) without damaging the flat surfaces. Although the material from which legs 16 are made is not critical to ladder top tool and parts carrier invention 2, in the preferred embodiment it is contemplated for legs 16 to be made from a pliable material, such as rubber, which will not scratch or mar the flat surfaces on which it is placed. Further, FIGS. 2 and 3 show ladder top tool and parts carrier invention 2 having a hammer slot 22 and a pliers slot 24 to hold pliers and similarly configured tools. FIG. 2 also shows ladder top tool and parts carrier invention 2 having a drill holder 26.

FIGS. 4 and 5 show ladder top tool and parts carrier invention 2 mounted onto the top portion of ladder 30 above ladder rungs 28. FIGS. 4 and 5 show ladder top tool and parts carrier invention 2 having pencil cavities 4 positioned in lateral portions of handle 20, as well as screwdriver cavities 10 and squaring tool slots 8 opening through the upper surface of support structure 3. FIGS. 4 and 5 also show legs 16 connected to the bottom of support structure 3 with bolts 12. In addition, FIG. 4 shows buckle 13 securing strap 14 around the upper portion of ladder 30. Also, FIG. 5 shows ladder top tool and parts carrier invention 2 having pliers cavity 24 and hammer slot 22.

It is contemplated for recess 18 to have a configuration to accommodate the upper portion of conventional six foot and eight foot ladders (not shown) which are most likely employed for household use and to cover only the top step of such a conventional ladder (not shown). Although the material from which support structure 3 is made is not critical to ladder top tool and parts carrier invention 2, the material used for support structure 3 should be strong and lightweight. In the preferred embodiment, it is contemplated for support structure 3 to comprise plastic materials. Also the construction of handle 20 and support structure 3 are not critical to ladder top tool and parts carrier invention 2. It is contemplated for handle 20 to be either attached to support structure 3 in a two-piece construction, or manufactured as a one-piece unit with support structure 3 by molded construction. It is also contemplated for ladder top tool and parts carrier invention 2 to have elongated means other than strap 14 and buckle 13 for securing recess 18 against the upper portion of ladder 30. Also, the number and configurations of screwdriver cavities 10, hammer slots 22, pliers cavities 24, parts cavities 6, drill holders 26, pencil cavities 4, and squaring tool slots 8 opening through the upper surface of support structure 3 are not critical to ladder top tool and parts carrier invention 2. It is contemplated for ladder top tool and parts carrier invention 2 to have any number and placement of screwdriver cavities 10, hammer slots 22, pliers cavities 24, parts cavities 6, drill holders 26, pencil cavities 4, and squaring tool slots 8 opening through the upper surface of support structure 3 and, although not shown, for ladder top tool and parts carrier invention 2 to have additional slots or cavities for other tools and parts.

What is claimed is:

1. A multi-functional carrier for organizing and storing within easy reach of a user a plurality of tools and a plurality of parts used in accomplishing commonly performed household maintenance and decorative projects, and which may be used both independently and while secured to the top portion of a step ladder having two angled frames joined at a top with a flat step, each of the angled frames having a pair of uprights and each of the uprights having an outboard lateral face and an outboard front face, said carrier comprising a support structure having an upper surface and a bottom surface; a recess in said bottom surface, said recess conformed for receipt of the flat step and embracing the outboard lateral face and the outboard front face of each of the uprights of a portion of each angled frame and a plurality of openings communicating through said upper surface of said support structure through which said tools and parts may be placed for storage.

2. The carrier of claim 1 further comprising a wide handle attached to said upper surface which allows both one-handed and two-handed use; said handle having a top surface and a plurality of narrow cavities laterally positioned on said handle, each of said narrow cavities having a size sufficient to house at least one pencil and an opening communicating through said top surface through which said tools and parts may be placed for storage.

3. The carrier of claim 1 wherein at least one of said openings is of sufficient size for placement of at least one pliers-like tool.

4. The carrier of claim 1 wherein at least one of said openings is of sufficient size for placement of at least one screwdriver-like tool.

5. The carrier of claim 1 wherein at least one of said openings is of sufficient size for placement of at least one hammer.

6. The carrier of claim 1 wherein at least one of said openings is of sufficient size for placement of at least one drill.

7. The carrier of claim 1 wherein at least one of said openings is of sufficient size for placement of at least one squaring tool.

8. The carrier of claim 1 wherein a strap-like device is attached to said support structure for securing said carrier to said top step of said ladder and comprises at least one belt and at least one buckle.

9. The carrier of claim 1 further comprising a plurality of legs attached to said bottom surface of said support structure and a plurality of bolts to attach said legs to said support structure, said legs being made from a pliable material so as to allow use of said carrier on flat surfaces without marring and scratching said flat surfaces.

10. The carrier of claim 9 wherein said legs are made of rubber.

11. A multi-functional carrier for organizing and storing within easy reach of a user a plurality of tools and a plurality of parts used for commonly performed household maintenance and decorative projects and which may be used both independently and while secured to the top portion of a step ladder having two angled frames joined at a top with a flat step, each of the angled frames having a pair of uprights and each of the uprights having an outboard lateral face and an outboard front face, said carrier comprising a support structure having an upper surface and a bottom surface; a wide handle attached to said upper surface which allows for both one-handed and two-handed use, said handle having a top surface and a plurality of laterally positioned narrow cavities, each of said narrow cavities having a width sufficient to house at least one pencil-like tool and an opening communicating through said top surface; a recess in said bottom surface, said recess conformed for receipt of the flat step and embracing the outboard lateral face and outboard front face of each of the uprights of a portion of each angled frame and also allow said carrier to support itself in a stable, upright condition when said carrier is placed on a flat surface; and a plurality of openings communicating through said upper surface of said support structure through which said tools and parts may be placed for storage.

12. The carrier of claim 11 wherein at least one of said openings is of sufficient size for placement of at least one pliers-like tool.

13. The carrier of claim 11 wherein at least one of said openings is of sufficient size for placement of at least one screwdriver-like tool.

14. The carrier of claim 11 wherein at least one of said openings is of sufficient size for placement of at least one hammer.

15. The carrier of claim 11 wherein at least one of said openings is of sufficient size for placement of at least one drill.

16. The carrier of claim 11 wherein at least one of said openings is of sufficient size for placement of at least one squaring tool.

17. The carrier of claim 11 wherein a strap-like device is attached to said support structure for securing said carrier to said top step of said ladder and comprises at least one belt and at least one buckle.

18. The carrier of claim 11 further comprising a plurality of legs attached to said bottom surface of said support structure and a plurality of bolts to attach said legs to said support structure, said legs being made from a pliable material so as to allow use of said carrier on flat surfaces without marring and scratching said flat surfaces.

19. The carrier of claim 18 wherein said legs are made of rubber.

20. A multi-functional carrier for organizing and storing within easy reach of a user a plurality of tools and a plurality of parts for commonly performed household maintenance and decorative projects and which may be used both independently and while secured to the top portion of a step ladder having two angled frames joined at a top with a flat step, each of the angle frames having a pair of uprights and each of the uprights having an outboard lateral face and an outboard front face, said carrier comprising a support structure having an upper surface and a bottom surface; a wide handle attached to said upper surface which allows both one-handed and two-handed use, said handle having a top surface and a plurality of laterally positioned narrow cavities, each of said narrow cavities having a width sufficient to house at least one pencil-like tool and an opening communicating through said top surface; a recess in said bottom surface, said recess conformed for receipt of the flat step and embracing the outboard lateral face and the outboard front face of each of the uprights of a portion of each angled frame and also allow said carrier to support itself in a stable, upright condition when said carrier is placed on a flat surface; a pair of elongated straps attached to said support structure for securing said carrier to said top step of said ladder; at least are buckle connected to each of said straps; a plurality of openings communicating through said upper surface of said support structure through which said tools and parts may be placed for storage; a plurality of rubber feet attached to said bottom surface of said support structure; and a plurality of bolts to attach said rubber feet to said support structure so as to allow use of said carrier on flat surfaces without marring and scratching said flat surfaces.

* * * * *